US005192895A

United States Patent [19]

Chang

[11] Patent Number: 5,192,895

[45] Date of Patent: Mar. 9, 1993

[54] SYNCHRONOUSLY-CONTROLLED LIGHT STRING

[75] Inventor: Ming C. Chang, Tainan Hsien, Taiwan

[73] Assignee: Taiwan Geni Electronics Co., Ltd., Tainan Hsien, Taiwan

[21] Appl. No.: 851,332

[22] Filed: Mar. 16, 1992

[51] Int. Cl.[5] ..... H05B 37/00; H05B 39/00

[52] U.S. Cl. ..... 315/201; 315/210; 315/250; 315/312; 315/313; 315/318; 315/320; 315/324

[58] Field of Search ..... 315/185 R, 185 S, 192, 315/195, 200 A, 210, 201, 250, 217, 312, 313, 314, 316, 317, 318, 319, 320, 324, 325

[56] References Cited

U.S. PATENT DOCUMENTS 3,803,452 4/1974 Goldschmied ..... 315/200 A
4,223,248 9/1980 Tong ..... 315/185 S
4,253,045 2/1981 Weber ..... 315/313
4,417,182 11/1983 Weber ..... 315/313
4,890,000 12/1989 Chou ..... 315/320
5,027,037 6/1991 Wei ..... 315/200 A

*Primary Examiner*—Paul M. Dzierzynski
*Assistant Examiner*—Michael B. Shingleton
*Attorney, Agent, or Firm*—Watson, Cole, Grindle & Watson

[57] ABSTRACT

A synchronously-controlled light string includes a plurality of light string units, each of which has a plug in one end and a socket in the other end, thereby allowing the light string units to be coupled together. Each light string unit has a control circuit and a plurality of lights. When the control circuit receives an AC power source signal, the signal is rectified, and frequency divided to obtain a train of clock pulses which are sent to a shifting circuit and a pattern selection circuit to control a driving circuit to drive the lights with a predetermined frequency.

2 Claims, 3 Drawing Sheets

SYNCHRONOUSLY-CONTROLLED LIGHT STRING

BACKGROUND OF THE INVENTION

This invention relates to a synchronously-controlled light string.

Commercialized sequentially-flashing light strings used at the present time are separated into a plurality of light string sets, each of which is controlled by a corresponding control line which comes out from a flashing control circuit which is set to have a selected flashing mode for controlling each control line to be energized or de-energized to further drive the corresponding light string sets.

However, the sequentially-flashing light strings as mentioned above need a plurality of control lines to couple therebetween. Therefore, when the light string is very long, the configuration of the control lines is inconvenient, and the light string is not practical.

Additionally, when the light string needs to be extended by using two dependent light strings, a synchronization problem will occur between the two independent flashing control circuits. Therefore, there remains a need for an extendible and synchronous light string.

SUMMARY OF THE INVENTION

A synchronously-controlled light string is provided and separated into a plurality of light string units, each of which comprises a plurality of lights and a synchronous control circuit to enable each light to flash sequentially, thereby constituting a sequentially-flashing light string.

It is an object of the present invention to provide a synchronously-controlled light string which is separated into a plurality of light string units, each of which comprises a control circuit which receives AC power and utilizes the frequency thereof to synchronously control the light string unit to form a sequentially flashing light string.

It is another object of the present invention to provide a synchronously-controlled light string which is extendible by adding more light string units thereto.

It is another object of the present invention to provide a synchronously-controlled light string which comprises a plurality of light string units, each of which comprises a synchronous control circuit which receives AC power and the frequency thereof as a base frequency to control the flashing of the light string unit.

It is another object of the present invention to provide a synchronously-controlled light string which comprises a plurality of light string units, each of which is connected by power lines without any shifting control lines, thereby allowing convenient installation.

It is another object of the present invention to provide a synchronously-controlled light string which comprises a plurality of light string units, each of which is set to a flashing mode, where each flashing mode is selected to be the same or different.

These and additional objects, if not set forth specifically herein, will be readily apparent to those skilled in the art from the detailed description provided hereunder, with appropriate reference to the accompanying drawings.

DETAILED DESCRIPTION OF THE PREFERRED EMBODIMENTS

Figure 3:
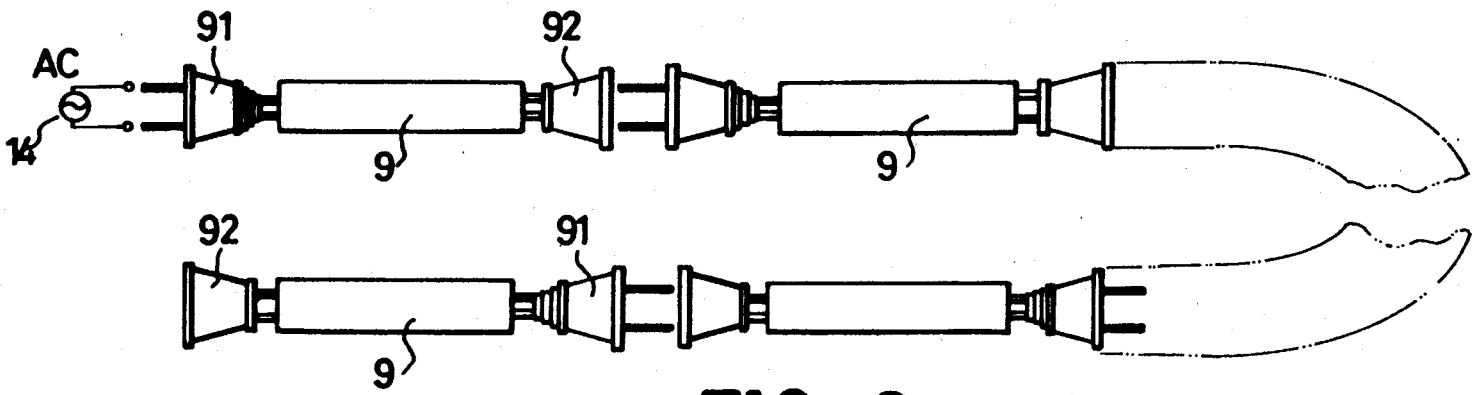
FIG. 3 is a schematic view of connections between a plurality of light string units.

Referring to FIG. 3, the synchronously-controlled light string in accordance with the present invention comprises a plurality of light string units 9, each of which has a plug 91 and a socket 92 disposed in respective ends thereof. The plug 91 and the socket 92 are connected to each other like a conventional extension cord. The length of a light string can be extended by adding more light string units 9 or shortened by removing some light string units 9. The length of the total light string is only limited by an AC power source 14.

Figure 2:
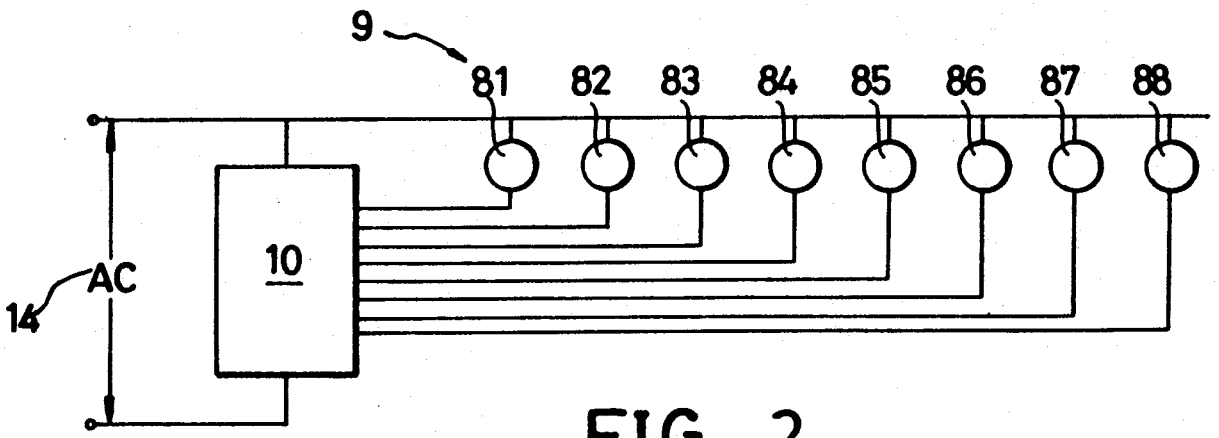
FIG. 2 is a schematic diagram of each light string unit in accordance with the present invention.

Referring to FIG. 2, a schematic diagram of each light string unit 9 supplied with the AC power source 14 is illustrated. Each light string unit 9 comprises a synchronous control circuit 10 and a plurality of lights 81 to 88 connected to output terminals of the synchronous control circuit 10. The synchronous control circuit 10 receives electricity from an AC power source 14 and utilizes the frequency thereof to control the flashing mode of lights 81 to 89. If more than two light string units 9 are connected, as shown in FIG. 3, and receives electricity from the same AC power source 14, then each light string unit 9 is synchronized by the frequency of the AC power source 14.

Figure 1:
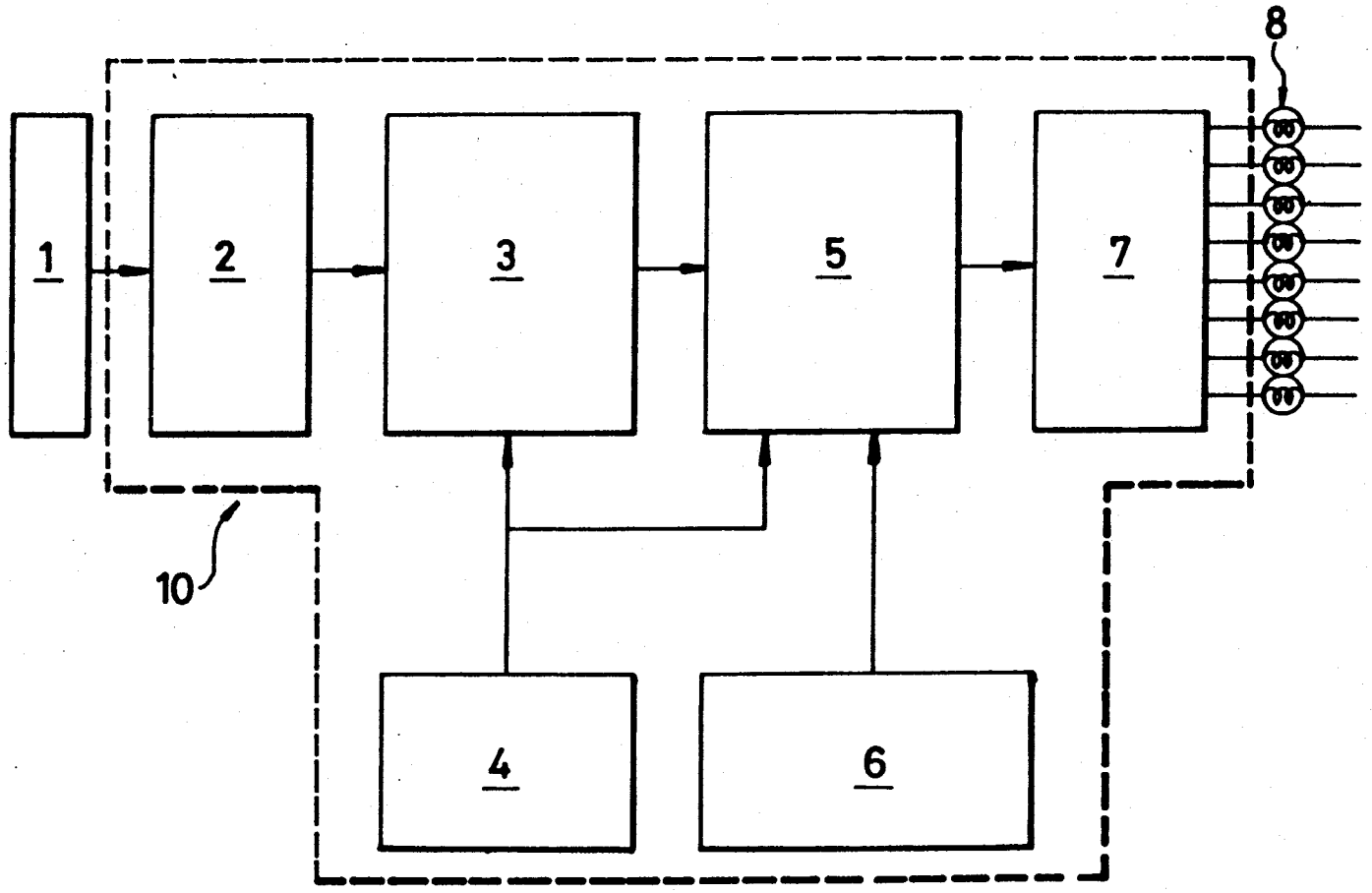
FIG. 1 is a block diagram of a synchronous control circuit in accordance with the present invention.

FIG. 1 illustrates how the control circuit 10 is connected to a power supply 1 at an input thereof, and connected to a light set 8 at output terminals thereof. The light set 8 comprises a plurality of lights corresponding to lights 81 to 88 of FIG. 2. However, the number of lights in the light set 8 is not limited to a specific number.

The power supply is coupled to a clock generator 2, which in turn is coupled to a frequency divider 3, a shifting circuit 5, and a driving circuit 7 which drives the light set 8. A resetting circuit 4 is connected to the frequency divider 3 and the shifting circuit 5 for providing a reset signal when power is initially applied. A shifting pattern selection circuit 6 is connected to the shifting circuit 5 for determining a flashing mode thereof. Actually, the power supply 1 comprises the AC power source 14 and a DC power source as described later.

When the alternating current of the AC power source 14 is inputted into the clock generator 2, a square wave is generated by the clock generator 2. The square wave is inputted into the frequency divider 3 and divided to generate a required clock signal for adjusting the flashing frequency of the light set 8. The clock signal is inputted into the shifting circuit 5, cooperating with the pattern selection circuit 6 to select a flashing mode for the shifting circuit 5 and further to send signals to driving circuit 7, which in turn drives the light set 8 to flash in a predetermined flashing mode as set in shifting circuit 5.

The synchronous control circuit 10 utilizes the frequency of the power supply 1 as the source of the oscillation frequency. Therefore, when a plurality of light string units 9 are coupled as shown in FIG. 3, each control circuit 10 thereof has a corresponding resetting circuit 4 for resetting divider 3 and the shifting circuit 5 when power is initially applied, thereby synchronizing all the light string units 9.

Additionally, each light string unit 9 is available to be set to a different flashing mode, thereby enabling the whole light string to flash with different flashing modes.

Figure 4:
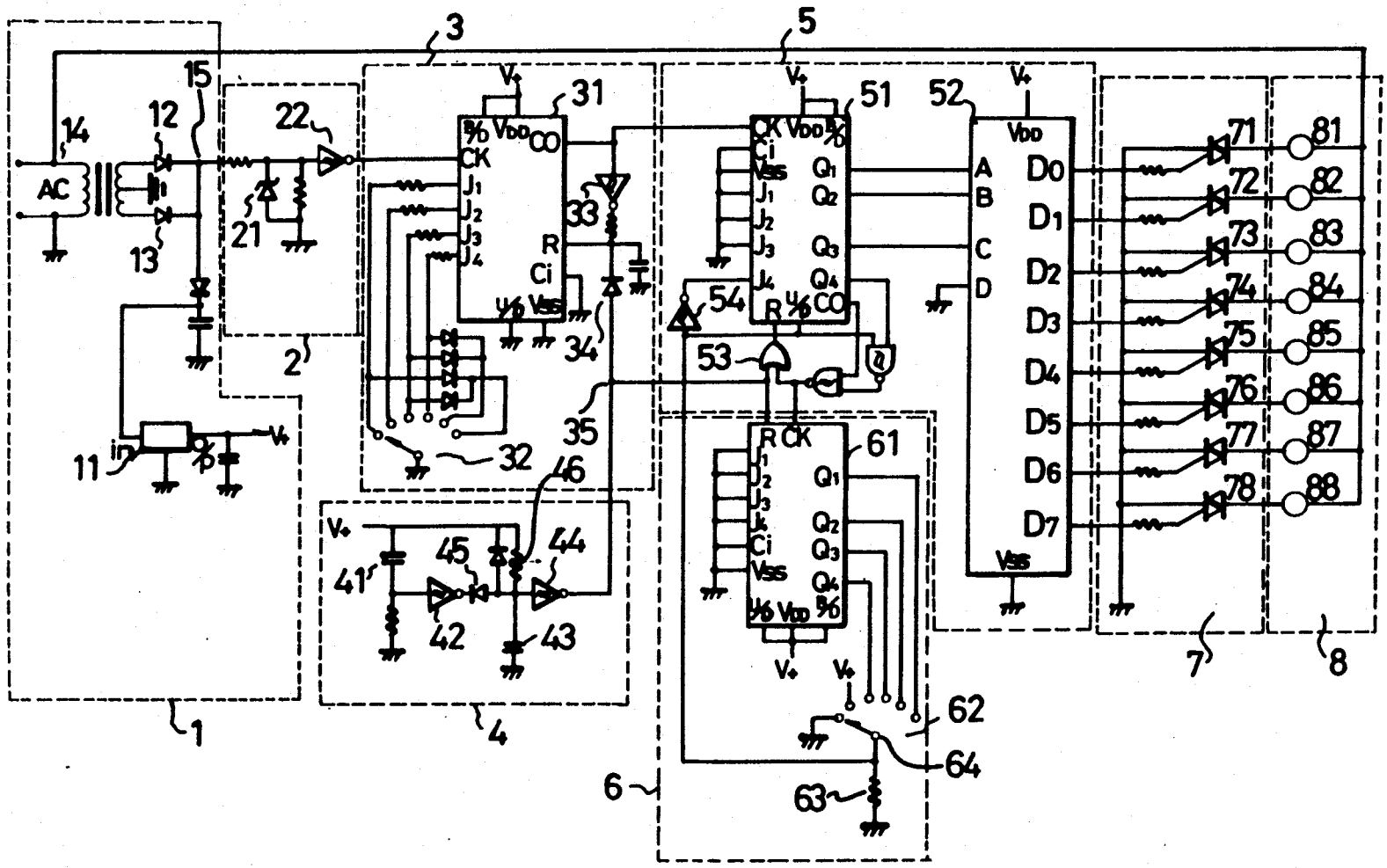
FIG. 4 is a detailed circuit of FIG. 1.

Referring to FIG. 4, there is shown a detailed circuit of FIG. 1 The power supply has an AC power source 14 which is rectified in full wave by two diodes 12 and 13. Therefore, if the AC power source 14 has a basic frequency $F_b$, then contact point 15 will obtain a rectified full wave having a frequency of $2F_b$. The rectified full wave is coupled to a commercial regulator 11 to obtain a DC voltage V+as the DC power of the whole system. Also, the rectified full wave is coupled to a Zener diode 21 and further to a Schmitt invertor 22 to obtain a clock signal with a frequency of $2F_b$. The $2F_b$ clock signal is provided to the frequency divider 3 as an input clock.

The frequency divider 3 has a first counter 31 and a first switch 32. The first switch 32 is manually controlled, single-pole six-throw switch which has a fixed contact grounded and six selection points connected to input terminals $J_1$, $J_2$, $J_3$, $J_4$ of the first counter 31. The status of the inputs "$J_4$ $J_3$ $J_2$ $J_1$"constitutes an original status of the first counter 31, and determines the division thereof. A carry output terminal Co outputs a divided clock signal to the shifting circuit 5. Whenever the first counter 31 is counted down to 0, the carry output Co is equal to logic "0" which is inverted by a second Schmitt invertor 33 and obtains a logic "1" to reset the first counter 31. A diode 34 is used to prevent this logic "1" to further couple to the shifting circuit 5. An up/-down (U/D) terminal of the first counter 31 is grounded, so the first counter 31 is a down counter herein.

The resetting circuit 4 has a first capacitor 41 connected to the DC power V+at one side thereof and connected to a second Schmitt invertor 42 at the other side thereof. The DC power is also connected to a first resistor 46 and to a second capacitor 43. The output of the third Schmitt invertor 42 is connected to a first diode 45 and further connected to a fourth Schmitt invertor 44. When the power is initially turned on, the capacitor 41 is charged, and a logic "1" is inputted to the invertor 42, which further outputs a logic "0" through the diode 45 to the invertor 44, which further outputs a logic "1" at a contact point 35. When the first capacitor 41 is fully charged, a logic "0" is provided to the invertor 42, which further outputs a logic "1" to the diode 45. The diode 45 blocks this logic "1". In the mean time, the second capacitor 43 is fully charged and provides a logic "1" to the third Schmitt invertor 44, which in turn outputs a logic "0" at contact point 35, and remains therein. Therefore, only a reset pulse is generated in the resetting circuit 4 when there is a power-on.

The shifting circuit 5 has a second counter 51 and a decoder 52. The second counter 51 receives the carry output $C_O$ from the first counter 3. Input terminals $J_3$, $J_2$, $J_1$ are grounded. A fifth Schmitt invertor 54 is coupled between an input terminal $J_4$ and an up/down (U/D) terminal of the second counter 51, such that when a logic "1" is inputted to terminal $J_4$, the counter 51 is a down counter, and when a logic "0" is inputted, an up counter. The decoder 52 receives outputs $Q_3$, $Q_2$, $Q_1$ from the second counter 51 and further outputs a logic "1" from one of output terminals $D_0$ to $D_7$ thereof.

The pattern selection circuit 6 has a third counter 61 and a manually controlled, single-pole six-throw switch 62. A fixed contact 64 of the switch 62 is connected to a first resistor 63 and to ground. The fixed contact 64 also couples to the up/down (U/D) terminal of the second counter 51. Input terminals $J_4$, $J_3$, $J_2$, and $J_1$ of the third counter 61 are grounded, and the up/down (U/D) terminal thereof is connected to the DC power V+, such that the third counter 61 functions as an up counter. Six selection contacts of the switch 62 are separately connected to ground (logic "0"), V+(logic "1"), and output terminals $Q_4$, $Q_3$, $Q_2$, and $Q_1$, such that the switch 62 is manually controlled to select a counting pattern for the second counter 51 of the shifting circuit 5. A counting pattern of the second counter 51 defines a corresponding flashing mode for the light set 8.

The driving circuit has a plurality of Triacs 71 to 78, each of which has a gate connected to one of the output terminals $D_0$ to $D_7$ of the decoder 52. Only one of the triacs 71 to 78 is actuated at a time. Each of the triacs 71 to 78 has an electrode connected to a light (from 81 to 88), respectively, and another electrode connected to ground. Each of the lights 81 to 88 has one end connected to a Triac and the other end connected to the AC power source 14.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A synchronously-controlled light string comprising a plurality of light string units, each of which comprises a plug and a socket disposed in respective ends thereof for coupling with those of adjacent said light string, a plurality of flashable lights, and a synchronous control circuit for receiving a power source frequence as actuating pulses to control said lights to flash with a predetermined frequency;

each said synchronous control circuit comprising a rectifier, a frequency divider, a shifting circuit, a driving circuit, and a resetting circuit, such that when an ac power source is input to said rectifier, the sine wave thereof is converted to a square wave which is then input into said frequency divider to obtain a required clock signal which triggers said shifting circuit and said driving circuit to drive said lights to flash with a predetermined frequency; said resetting circuit resetting a corresponding said frequency divider and said shifting circuit when power is initially applied thereby synchronizing each said light string unit.

2. The synchronously-controlled light string as claimed in claim 1, wherein each said shifting circuit receives a clock signal from said frequency divider and cooperates with a pattern selection circuit for determining a flashing frequency for said lights.

* * * * *